US006310599B1

(12) United States Patent
Bril et al.

(10) Patent No.: US 6,310,599 B1
(45) **Date of Patent: *Oct. 30, 2001**

(54) METHOD AND APPARATUS FOR PROVIDING LCD PANEL PROTECTION IN AN LCD DISPLAY CONTROLLER

(75) Inventors: Vlad Bril, Campbell; Alexander Julian Eglit, Half Moon Bay; Robin Sungsoo Han, Saratoga; Muralidhar Reddy Jammula, Fremont, all of CA (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/704,842

(22) Filed: Aug. 28, 1996

Related U.S. Application Data

(63) Continuation of application No. 08/572,905, filed on Dec. 22, 1995, now abandoned.

(51) Int. Cl.[7] ..... G09G 3/33
(52) U.S. Cl. ..... 345/99; 345/211
(58) Field of Search ..... 345/87, 88, 89, 345/98, 100, 66, 102, 211, 212, 213, 204, 205

(56) References Cited

U.S. PATENT DOCUMENTS

| | | | | |
|---|---|---|---|---|
| 4,827,347 | | 5/1989 | Bell | 358/224 |
| 4,845,482 | | 7/1989 | Howard et al. | 340/805 |
| 5,179,345 | | 1/1993 | Jenkins et al. | 324/678 |
| 5,233,331 | | 8/1993 | Comerford et al. | 340/712 |
| 5,239,293 | | 8/1993 | Barbier | 340/784 |
| 5,247,286 | * | 9/1993 | Ishikawa | 345/211 |
| 5,252,959 | | 10/1993 | Kono | 345/147 |
| 5,254,982 | | 10/1993 | Feigenblatt et al. | 345/148 |
| 5,266,933 | | 11/1993 | Frank et al. | 345/141 |
| 5,270,687 | | 12/1993 | Killebrew, Jr. | 345/150 |
| 5,287,100 | | 2/1994 | Guttag et al. | 345/213 |
| 5,293,468 | | 3/1994 | Nye et al. | 395/131 |
| 5,302,985 | | 4/1994 | Kennedy et al. | 353/122 |
| 5,309,551 | | 5/1994 | Guttag et al. | 395/131 |
| 5,319,381 | | 6/1994 | Mourey et al. | 345/100 |
| 5,327,159 | | 7/1994 | Van Aken et al. | 345/153 |
| 5,341,470 | | 8/1994 | Simpson et al. | 395/164 |
| 5,369,432 | | 11/1994 | Kennedy | 348/181 |
| 5,384,579 | * | 1/1995 | Nakasuji et al. | 345/123 |
| 5,387,923 | | 2/1995 | Mattison et al. | 345/103 |
| 5,399,114 | | 3/1995 | Park | 445/1 |
| 5,400,057 | | 3/1995 | Yin | 345/199 |
| 5,416,496 | | 5/1995 | Wood | 345/102 |
| 5,418,485 | | 5/1995 | Duret et al. | 327/172 |
| 5,436,636 | | 7/1995 | Nonoshita et al. | 345/100 |
| 6,115,032 | * | 9/2000 | Kotha et al. | 345/211 |

* cited by examiner

*Primary Examiner*—Xiao Wu
(74) *Attorney, Agent, or Firm*—Robert A. Bell; Steven Lin

(57) ABSTRACT

A flat panel display controller is provided with a circuit for monitoring clocking signal(s) to the flat panel display. A clocking signal output to the flat panel display may be fed back to the display controller using a conventional I/O pad. In the preferred embodiment, the fed back clocking signal resets a counter. In a second embodiment, the fed back clocking signal may then pass through an edge detector whose output then resets the counter. The counter will overflow if a edge signal is not received within a predetermined time period. If an overflow occurs, the carry signal of the counter will initiate a flat panel power shutdown through power control circuitry. The clock signal for the counter may be derived from an off-chip oscillator such that if a failure occurs within the display controller, the counter will continue to function.

17 Claims, 4 Drawing Sheets

METHOD AND APPARATUS FOR PROVIDING LCD PANEL PROTECTION IN AN LCD DISPLAY CONTROLLER

CROSS-REFERENCE TO RELATED APPLICATIONS

This application is a continuation of Ser. No. 08/572,905 entitled "METHOD AND APPARATUS FOR PROVIDING LCD PANEL PROTECTION IN AN LCD DISPLAY CONTROLLER" filed on Dec. 22, 1995 now abandoned.

FIELD OF THE INVENTION

The present invention relates to an apparatus and method for protecting LCD panels from damage during manufacturing, development, and operation. The present invention has particular application to passive and active matrix monochrome and color flat panel displays.

BACKGROUND OF THE INVENTION

Flat panels displays are known for use with computer systems, particularly laptop or portable computers and the like. Such flat panel displays may also be applied to other types of devices such as televisions or television monitors, industrial and automotive controls and the like. LCD panels are particularly popular for use in panel displays due to their relatively low cost and high resolution.

LCD panels use a layer of liquid crystal material portions of which may be controllably aligned in particular directions using a bias voltage. Polarized light may pass through portions of the liquid crystal or be reflected, depending upon bias voltage application (and liquid crystal alignment) at a particular portion. Signals provided by a passive or active matrix may thus twist portions of the LCD crystal to generate display elements.

The liquid crystal display has a structure similar to a capacitor in that an insulator (liquid crystal) may be provided between two electrodes (bias voltage lines). The bias voltage may be provided with an AC component to prevent breakdown of the liquid crystal over time. If the bias voltage is not provided with such an AC component, electrolysis may occur within the liquid crystal display, and the liquid crystal may segregate and breakdown, causing permanent damage to the liquid crystal display.

LCD panels may also be damaged in other ways. For example, voltage or current drivers provided within an LCD display device to provide bias voltages may be overdriven to a point where an individual LCD driver may be damaged.

Such damage may result in all or portions of an LCD display being disabled. For example, if an individual line driver is damaged within an LCD panel, a corresponding line may not be driven, resulting in a missing line or stripe is appearing in the LCD display.

Such damage may occur to an LCD panel if an LCD display is operated without proper clock (e.g., frame clock, line clock, pixel clock, or the like) or control signals. Power and clock signals to an LCD display may be applied and removed in a particular order and fashion in order to prevent damage to the panel. FIG. 1 is a waveform diagram illustrating the order in which clock and power signals may be applied to and removed from an LCD panel in order to prevent damage to a panel.

As illustrated in FIG. 1, power control signal GR1 may first be asserted to an LCD panel. Next, LCD timing signals (e.g., line clock, frame clock, pixel clock) may be applied to a panel. Third, a power control signal GR2 may be applied to an LCD panel. Power control signals GR1 and GR2 may represent reference voltages (e.g., positive and negative) used to generate an AC bias signal to the flat panel display.

When these power and clock signals have been applied in this order, an LCD panel may be successfully power up without damage. To power down an LCD panel, the power and clock signals may be removed in a reverse order. Relative timings t1, t2, t3, and t4, between application of the various signals may be specified by a panel manufacturer to prevent malfunction and/or damage to the panel.

FIG. 2 is a simplified block diagram illustrating the connection of flat panel display timing signal lines from a display controller 250 to a flat panel display 201. Signal lines 202, 203, and 204 transmit clock signals LFS, LLCLK, and SCLK, respectively. Signal LFS is a clock signal indicating field timing for a display image. Signal LLCLK is a line clock signal for a display image, while SCLK is a pixel clock signal for a display image.

Signal lines 202, 203, and 204 may pass through pad drivers 210, 209, and 208, respectively to output pads 207, 206, and 205, respectively, of display controller 250. Such pad drivers and output pads are known in the semiconductor art. In the prior art, an output-only pad (i.e. a pad driven only by an output pad driver) may have been used with such clock signals, as such clock signal lines 202, 203, and 204 are generally output-only lines.

Under normal operation, it may be somewhat difficult; for a situation to arise where an LCD panel may be damaged due to normal inputs from a display controller. However with the advent of more sophisticated operating systems software (e.g., Window™ 95, O/S 2™ or the like) situations may arise where proper clock or control signal may not be generated, particularly if a user incorrectly configures a computer system (e.g., changing mode incorrectly).

In addition, such situations may arise when a component within a computer system malfunctions. For example, if a display controller IC or other component driving a flat panel display fails in whole or part, the flat panel display may also fail if control or clock signals are distorted or cut off in a particular manner. For example, if clock signals to a flat panel display are terminated while power control signals remain applied, damage to the current or voltage supplies within the panel may occur.

Moreover, when developing and testing new computer systems, it may be necessary to test new components (e.g., display controllers or the like) with actual flat panel displays. In addition, during manufacture of computer systems (e.g., laptop computer or the like) it may be necessary to power up new systems to check components (e.g., burn-in or the like). During such testing and/or burn-in, improper clocking signals and/or control signals may be generated or may be missing for the flat panel controller. In a relatively short period of time (e.g., seconds or less) a flat panel display may be partially or totally destroyed, if such clocking and/or control signals are missing or improper. Damage to bias voltage drivers may occur within milliseconds, whereas damage to crystals within an LCD display may take longer.

If a particular development or manufacturing problem is encountered numerous times, a number of flat panel displays may be destroyed before the problem can be corrected. The cost of such destroyed displays may significantly increase the cost of development of computer components and/or the cost of manufacturing new computers. Thus, it remains a requirement in the art to provide a means for protecting flat panel displays from incorrect or missing timing signals in order to prevent damage or destruction of such displays.

SUMMARY OF THE INVENTION

A flat panel display controller includes an output driver for outputting a clock signal to a flat panel display. A corresponding input driver, coupled to the output driver, feeds back the clock signal to the flat panel display controller.

In the preferred embodiment, the output of input pad driver serves to reset a counter, which otherwise counts freely from a time base. The time base may be independently generated off-chip with a frequency depending upon which signal is to be monitored. If the counter overflows, a carry signal is output to a flat panel power control sequence circuit to shut down power to flat panel display before damage occurs.

In a second embodiment, an edge detecting circuit, coupled to the input driver, detects edge transitions in the clock signal and outputs a pulse when an edge transition is detected.

The output of the edge detecting circuit is fed to a MUX which is driven by a window signal to MUX the output of the edge detecting circuit with a divided value of the edge detection circuit in order to compensate for horizontal and vertical retrace periods. The output: of the MUX resets a counter which is clocked by an independent time base. If the counter overflows, a carry signal is output to a flat panel power control sequence circuit to shut down power to flat panel display before damage occurs.

BRIEF DESCRIPTIONS OF THE DRAWINGS

DETAILED DESCRIPTION OF THE INVENTION

Figure 3:
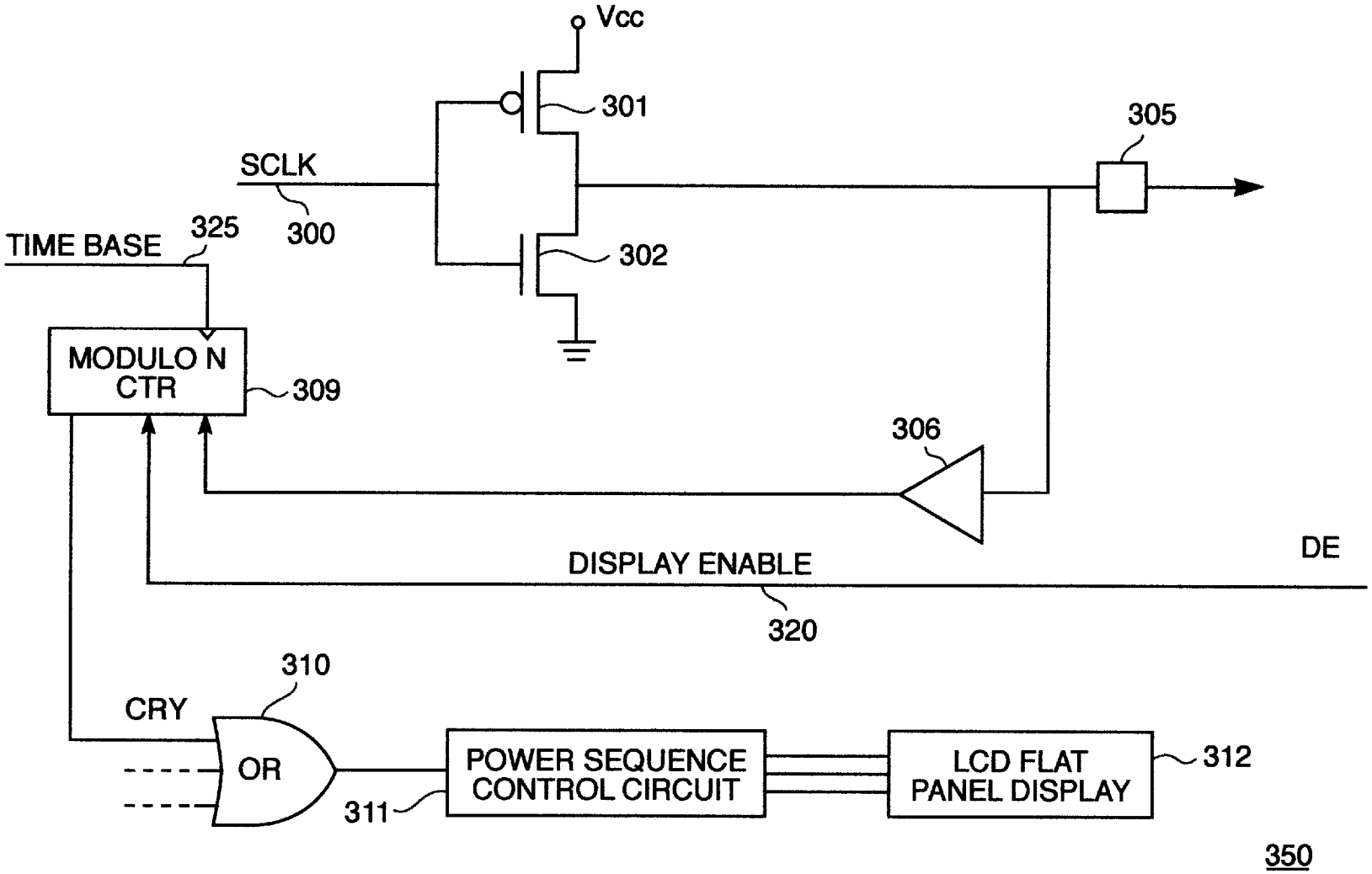
FIG. 3 is a block diagram illustrating the preferred embodiment of the present invention.

FIG. 3 is a block diagram illustrating the preferred embodiment of the present invention and also illustrating schematically the structure of a pad driver. As illustrated in FIG. 3, display controller 350 may include a signal line 300 which in turn may be provided with a pad driver comprising complimentary MOS (CMOS) transistors 301 and 302, as is known in the art.

For the purposes of illustration, signal line 300 is shown as representing signal line SCLK. However, similar circuitry may also be provided to monitor any of the LLCLK, or LFS clock signal lines as well. It will be appreciated by one of ordinary skill in the art that the elements illustrated in FIG. 3 may be replicated for all three signal lines (SCLK, LLCLK, and LFS) if required.

Figure 1:
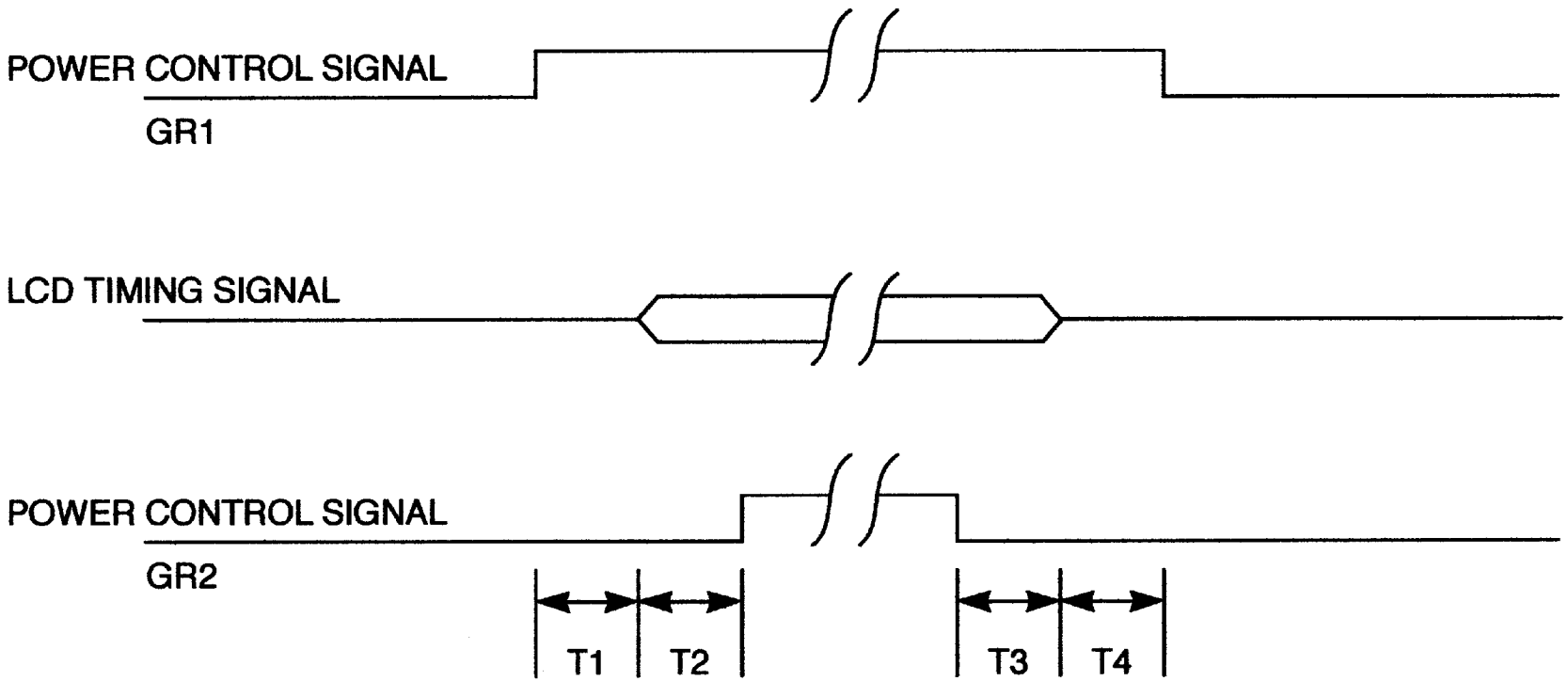
Figure 1 (Prior Art)
FIG. 1 is a waveform diagram illustrating the order in which clock and power signals must be applied to and removed from an LCD panel in order to prevent damage to a panel.
Figure 2:
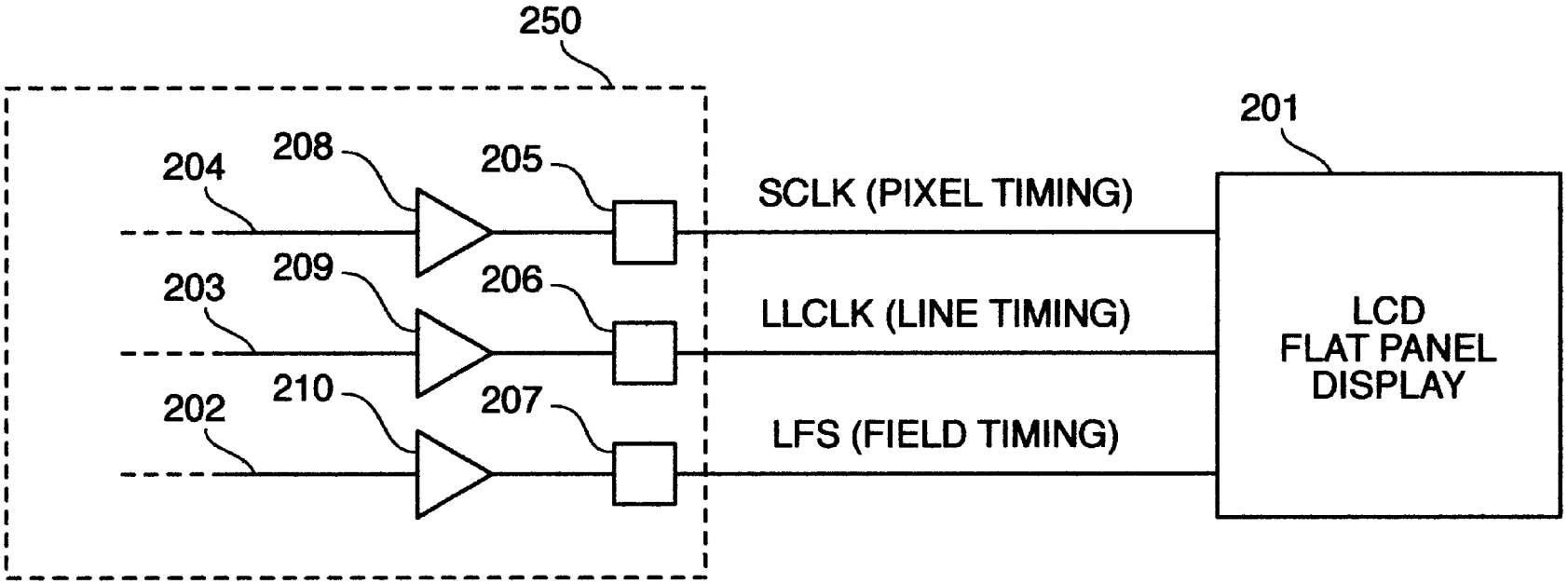
FIG. 2 is a simplified block diagram illustrating the connection of flat panel display timing signal lines from a display controller 250 to a flat panel display 201.

The output of the output pad driver comprising CMOS transistors 301 and 302 may be fed to contact pad 305 which in turn may be coupled to an LCD flat panel display as is known in the art. However, unlike prior art FIG. 2, contact pad 305 may comprise an I/O pad, as indicated by the presence of input pad driver 306. Such I/O pad drivers are known in the art for other signal and data line applications within integrated circuits. Thus the design and implementation of such an I/O pad is well known to those of ordinary skill in the art and may be readily implemented within an integrated circuit design.

However, in most applications of an I/O pad, an input signal is expected through the pad from an external device, and thus the requirement for both input and output pad drivers. In the present invention, however, input pad driver 306 is applied to feed back the output signal of signal line 300 to circuitry within display controller 350.

The output of input pad driver 306 may comprise whatever clock signal is to be driven over signal line 100, in this example, pixel timing signal SCLK. If a clock signal driven over signal line 300 should become disabled or irregular, the elements illustrated in FIG. 3 will detect such an occurrence as follows.

The output of pad driver 306 serves to reset counter 309, which otherwise counts freely from time base 325. Time base 325 may be independently generated off-chip in order to insure proper operation of the circuit. Otherwise, an on-chip failure which results in failure of flat panel clocking signals could result in the failure of the counter time base, thus disabling the panel protection circuit.

The frequency of time base 325 may depend upon which signal (e.g., LLCLK or SCLK) is to be monitored, due to the different frequency characteristics of such monitored signals. In the preferred embodiment, for SCLK monitoring, a 3 to 14 Mhz external clock may be used for time base 325. Such an external clock signal may be readily available (or divided down from) from an existing external oscillator applied to a display controller 350 as a base for on-chip clock synthesizers. Thus, no additional external clock may be needed for SCLK monitoring.

For monitoring LLCLK, a slightly lower frequency clock may be used. In the preferred embodiment, a 32 Khz clock may be utilized which may be provided by or derived from an external power control clock signal which may be readily available to a display controller 350. Alternately, such a clock signal may be derived from the external oscillator used as a time base for SCLK monitoring. Field timing signal LFS may be monitored using the line timing signal LLCLK as a time base. In the preferred embodiment, signal LFS is not monitored. It can be appreciated that the circuit of FIG. 3 may be modified to monitor field timing signal LFS. In such an embodiment, the use of MUX 308 to compensate for vertical and horizontal retrace periods may be unnecessary.

Display Enable signal 320 may be provided to modulo N counter 309 as an enable/disable signal to compensate for the lack of clocking signals during horizontal and vertical retrace intervals. Display Enable signal 320 may be generated by a display controller as is known in the art.

Counter 309 may be preset to a particular level (e.g., modulo N, where N is the number of counts desired), such that if carry signal CRY is generated, a timeout condition occurs. The value of N may be chosen such that:

$$N \geq f(SCLK)/f(TimeBase) \qquad \text{EQ. 1}$$

Where f(SCLK) is the frequency of the pixel timing signal (or the signal to be monitored) and f(TimeBase) is the frequency of Time Base signal 325. It can be appreciated that the value of N and the frequency of Time Base signal 325 may be empirically adjusted such that a missing SCLK (or other clock to be monitored) is detected. before damage may occur to the flat panel display while prevent spurious shutdowns of the flat panel display due to temporary glitches in panel timing (e.g., mode changes, reboot, or the like).

Thus, reset counter 309 functions in a manner similar to a watchdog timer. Carry signal CRY is fed through OR gate 310 to power sequence control circuit 311. Power sequence control circuit 311 is a circuit known in the prior art for shutting down power to a flat panel display, for example, in a laptop computer.

Power sequence control circuit 311 may be provided with an emergency shutdown procedure for terminating bias voltage to LCD flat panel display 312 to prevent damage to the display. OR gate 310 may be provided to OR carry signal CRY with other signals which may be generated by a computer system (e.g., laptop, notebook or the like) to terminate power to LCD flat panel display 312 (e.g., sleep, power save, or off modes).

In practice, such a feedback monitoring circuit may be: applied to LLCLK (line timing) and SCLYK (pixel timing) signal lines. Flat panel displays may typically use the LLCLK signal or a derivative thereof to generate an AC bias signal for biasing the liquid crystal. Such an AC bias signal may comprise a switched waveform of power control signals GRl and GR2 switched at the frequency of signal LLCLK or a derivative thereof. If the LLCLK signal is interrupted, then the AC bias signal may be stalled or interrupted and panel damage may occur. Thus, detecting a stoppage of LLCLK or SCLK signals and immediately shutting down power to a flat panel display may serve to prevent damage to the display.

In addition, the bias voltages within a flat panel display may be relatively high (e.g, ±18 to 42 volts). Thus, the driver circuitry within a flat panel display may comprise high voltage drivers, which, due to design constraints, may be prone to latchup conditions. In some brands and models of flat panels displays, if the SLCK signal to the display is interrupted, a latchup condition may occur, damaging the high voltage drivers within the flat panel display. Thus, detecting a stoppage of the SCLK signal and immediately shutting down power to the flat panel display may serve to prevent permanent damage to the display.

Figure 4:
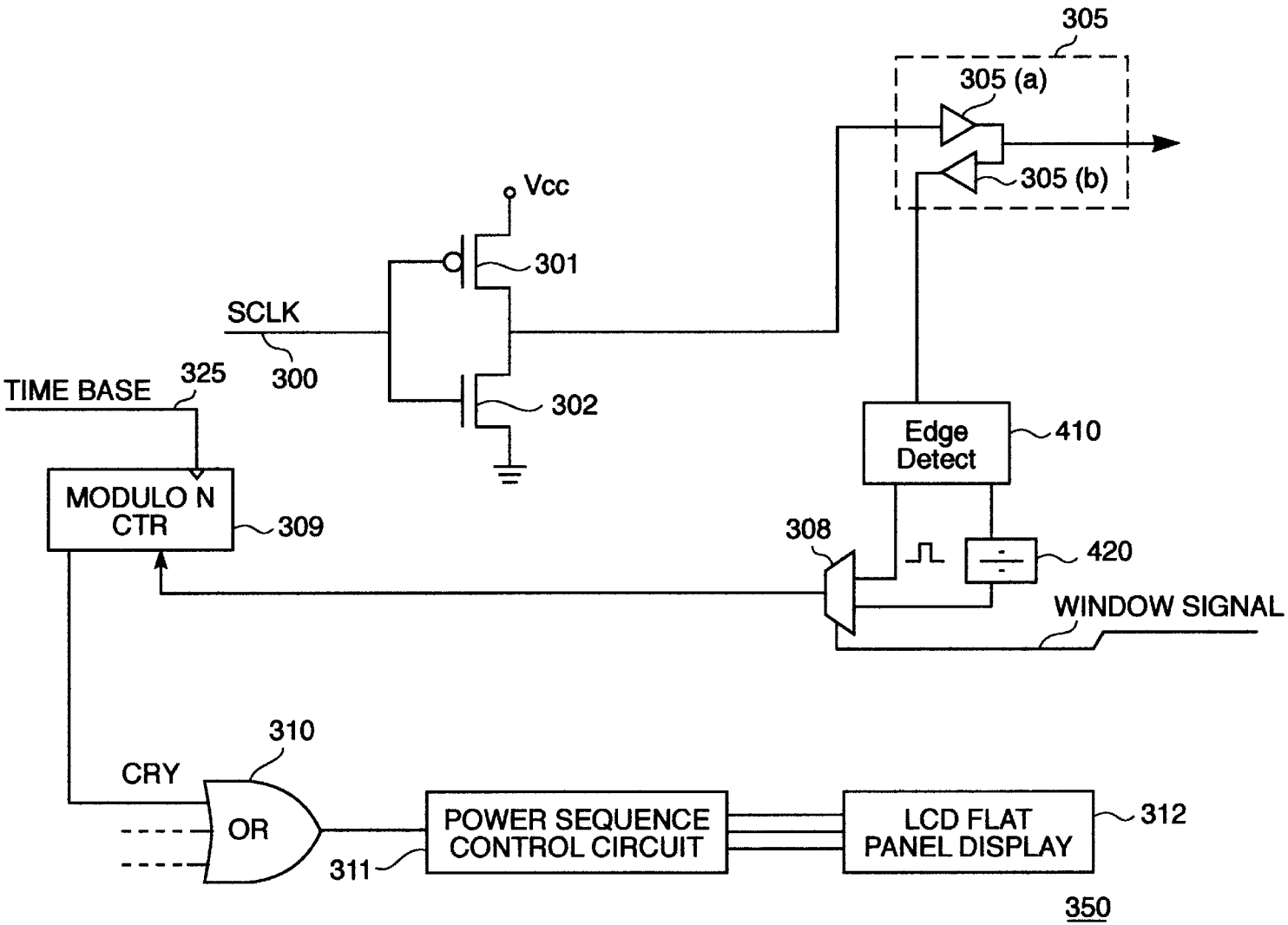
FIG. 4 is a block diagram illustrating a second embodiment of the present invention.

FIG. 4 is a block diagram illustrating a second embodiment of the present invention. In FIG. 4, output driver 305 is illustrated as two drivers 305(*a*) and 305(*b*) comprising input and output signal drivers. Such I/O pad drivers are well known in the art. Output driver 305(*a*) outputs a clock signal to flat panel display 312. A corresponding input driver 305(*b*), coupled to output driver 305 (*a*), feeds back the clock signal to the flat panel display controller (not shown). An edge detecting circuit 410, coupled to input driver 305 (*b*), detects edge transitions in the clock signal and outputs a pulse when an edge transition is detected.

The output of edge detecting circuit 410 is fed to MUX 308 which is driven by a window signal to MUX the output of edge detecting circuit 410 with a divided value of the edge detection circuit. produced by divider 420 in order to compensate for horizontal and vertical retrace periods. The output of MUX 308 resets a counter which is clocked by independent time base 325. If counter 308 overflows, a carry signal CRY is output to flat panel power control sequence circuit 311 through OR gate 310 to shut down power to flat. panel display 312 before damage occurs.

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A display controller for controlling a flat panel display, comprising:

an output driver for outputting a clock signal to a flat panel display;

an input driver, coupled to said output driver, for feeding back the clock signal to the flat panel display controller;

a counter having a reset input coupled to a said input driver, for counting an independently generated clock signal and outputting a carry signal when a predetermined count is reached; and a flat panel power control sequence circuit, coupled to said counter, for receiving the carry signal and shutting off power to flat panel display in response to the carry signal, wherein said counter further comprises an enable input coupled to a display enable signal, for enabling and disabling said counter in response to the display enable signal such that said counter is disabled during vertical and horizontal retrace intervals.

2. The display controller of claim 1, wherein said independently generated clock signal comprises an external oscillator.

3. The display controller of claim 2 wherein the clock signal comprises a pixel clock signal and the independently generated clock signal comprises a 3 to 14 Mhz external clock.

4. The display controller of claim 2 wherein the clock signal comprises a line clock signal and the independently generated clock signal comprises 32 Khz clock signal.

5. The display controller of claim 1 wherein the clock signal comprises a field timing signal and the independently generated clock signal comprises a line clock signal.

6. A computer comprising:

a flat panel LCD display;

a display controller, coupled to said flat panel LCD display for generating timing and control signal for controlling said flat panel LCD display, said display controller comprising:

output driver for outputting a clock signal to a flat panel display;

an input driver, coupled to said output driver, for feeding back the clock signal to the flat panel display controller;

a counter having a reset input coupled to a said input driver, for counting an independently generated clock signal and outputting a carry signal when a predetermined count is reached; and a flat panel power control sequence circuit, coupled to said counter, for receiving the carry signal and shutting off power to flat panel display in response to the carry signal, wherein said counter further comprises an enable input coupled to a display enable signal, for enabling and disabling said counter in response to the display enable signal such that said counter is disabled during vertical and horizontal retrace intervals.

7. The computer of claim 6, wherein the independently generated clock signal comprises an external oscillator.

8. The computer of claim 7 wherein the clock signal comprises a pixel clock signal and the independently generated clock signal comprises a 3 to 14 Mhz external clock.

9. The computer of claim 7 wherein the clock signal comprises a line clock, signal and the independently generated clock signal comprises 32 Khz clock signal.

10. The computer of claim 6 wherein the clock signal comprises a field timing signal and the independently generated clock signal comprises a line clock signal.

11. The method of controlling a flat panel display so as to prevent damage to the flat panel display in the event a clock signal is interrupted, the method comprising the steps of:

outputting a clock signal through an output driver to a flat panel display, feeding back the clock signal from the output driver through an input driver, counting, in a counter, an independently generated clock signal, resetting the counter with the clock signal, outputting, from the counter, a carry signal when a predetermined count is reached, receiving the carry signal in a flat panel power control circuit and shutting off power to flat panel display in response to the carry signal, and enabling and disabling said counter in response to a display enable signal such that said counter is disabled during vertical and horizontal retrace intervals.

12. The method of claim 11, wherein the independently generated clock signal comprises an external oscillator.

13. The method of claims 12 wherein the clock signal comprises a pixel clock signal and the independently generated clock signal comprises a 3 to 14 Mhz external clock.

14. The method of claim 12 wherein the clock signal comprises a line clock signal and the independently generated clock signal comprises 32 Khz clock signal.

15. The method of claim 11 wherein the clock signal comprises a field timing signal and the independently generated clock signal comprises a line clock signal.

16. A display controller for controlling a flat panel display, comprising:

an output driver for outputting a clock signal to a flat panel display;

an input driver, coupled to said output driver, for feeding back the clock signal to the flat panel display controller;

a counter having a reset input coupled to a said input driver, for counting an independently generated clock signal and outputting a carry signal when a predetermined count is reached;

a flat panel power control sequence circuit, coupled to said counter, for receiving the carry signal and shutting off power to flat panel display in response to the carry signal; and an edge detector, coupled to the input driver, for detecting an edge transition of a signal from the input driver and outputting a signal upon detection of such an edge transition to the reset input of said counter.

17. The display controller of claim 16, further comprising:

a MUX, coupled to said edge detector and said counter, for MUXing the signal from the edge detector with a divided signal from the edge detector, said MUX being switched by a window signal indicating the presence of a retrace period.

* * * * *